US006498595B1

(12) United States Patent
Knapp et al.

(10) Patent No.: US 6,498,595 B1
(45) Date of Patent: Dec. 24, 2002

(54) ACTIVE MATRIX LIQUID CRYSTAL DISPLAY DEVICES

(75) Inventors: Alan G. Knapp, Crawley (GB); Martin J. Edwards, Crawley (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/286,103

(22) Filed: Apr. 2, 1999

(30) Foreign Application Priority Data

Apr. 4, 1998 (GB) ..... 9807184

(51) Int. Cl.[7] ..... G09G 3/36
(52) U.S. Cl. ..... 345/94; 345/100
(58) Field of Search ..... 345/94, 99, 95, 345/208, 209, 210

(56) References Cited

U.S. PATENT DOCUMENTS

| | | | | |
|---|---|---|---|---|
| 5,130,829 A | | 7/1992 | Shannon | 359/59 |
| 5,132,677 A | * | 7/1992 | Nicholas | 345/92 |
| 5,379,050 A | * | 1/1995 | Annis et al. | 345/94 |
| 5,400,048 A | * | 3/1995 | Shimada et al. | 345/94 |
| 5,506,599 A | * | 4/1996 | Iwama | 345/94 |
| 5,790,090 A | * | 8/1998 | Libsch et al. | 345/94 |
| 5,812,106 A | * | 9/1998 | Hughes | 345/90 |
| 5,923,310 A | * | 7/1999 | Kim | 345/90 |
| 5,940,057 A | * | 8/1999 | Lien et al. | 345/89 |
| 6,057,818 A | * | 5/2000 | Cole | 345/94 |
| 6,084,563 A | * | 7/2000 | Ito et al. | 345/100 |

OTHER PUBLICATIONS

The Paper by T. Kamiya et al. Entitled "A Novel Driving Method of TFT–LCD with Low Power Consumption" published in Prov. AMLCD '94, Toyko, pp. 60–62.

15–3 Simplified Method of Capacitively Coupled Driving for TFT–LCD by E. Takeda et al., in Japan Display; '89 pp. 580–583.

* cited by examiner

*Primary Examiner*—Vijay Shankar
*Assistant Examiner*—Nitin Patel

(57) ABSTRACT

In an active matrix LC display device having an array of display elements (12) addressed via respective transistors (11) connected to sets of row address conductors (14) to which selection pulses are applied in sequence and column address conductors (16) to which data signals are applied, and a storage capacitor (18) connected between each display element and a row conductor adjacent that to which its associated transistor is connected and which is operable in a capacitive coupling drive mode in which a step level in the waveform applied to each row conductor contributes to the final display element voltage, the row drive waveform applied to each row conductor includes a step level both before and after the selection pulse. Through this, the vertical scanning direction used can readily be reversed and an advantageous dot-inversion drive scheme can be employed.

17 Claims, 3 Drawing Sheets

ACTIVE MATRIX LIQUID CRYSTAL DISPLAY DEVICES

BACKGROUND OF THE INVENTION

This invention relates to active matrix liquid crystal display devices comprising a row and column array of display elements each of which is connected to a transistor, sets of row and column address conductors connected to the transistors, each display element having an associated storage capacitor connected between the display element and a row address conductor adjacent that to which the transistor associated with the display element is connected, and a drive circuit for applying data signals to the column conductors and, during a row address period for each row of display elements, a selection pulse signal to each row conductor in sequence for driving the display elements, the drive circuit being arranged to provide adjacent to a selection pulse signal in the row drive waveform a step level which exists at the termination of a selection pulse signal on an adjacent row conductor and contributes to a drive voltage obtained on a display element via its associated storage capacitor.

Active matrix liquid crystal (LC) display devices using thin film transistors (TFTs) are well known. The general operation of a typical device and its manner of construction are described, for example, in U.S. Pat. No. 5,130,829. A number of different approaches to improving display quality and performance have been pursued. One particular technique which has been introduced to improve the quality of the display output, especially image sticking effects, by compensating for the dc voltage coupled onto a display element via the gate-drain capacitance of its associated TFT and to enable lower voltage column drive circuitry to be employed is the so-called capacitively coupled drive scheme. This scheme is applicable to display devices which use storage capacitors in association with the display elements that are connected to an adjacent row address conductor (i.e. different to that to which the display element's TFT is connected) and which operate in a line, (row), or field inversion mode. Rather than the waveform supplied to each row address conductor comprising simply a hold level and, once per field period, a selection (gating) pulse level which is operable to turn on the TFTs connected to that conductor in a respective row address period, the waveform used in this scheme further includes an intermediate step level. In operation, the display element is charged, through its associated TFT, to a certain level according to the value of the supplied data signal and once the TFT has been turned off at the end of the selection pulse signal to isolate the display element a voltage step of the waveform applied to the adjacent row address conductor is coupled onto the display element via the storage capacitor to take the final display element voltage to a desired level to produce a required display effect, i.e. gradation level, from the display element. Thus, a step level of the waveform applied to one row address conductor contributes to the voltages obtained on the display elements in a row selected by a different, adjacent, row address conductor via their associated storage capacitors. By appropriate adjustment of the step level, this technique can be used to compensate for kickback effects.

Examples of capacitively coupled drive schemes used in TFT LC display devices are described in the paper by E. Takeda et al entitled "Simplified Method of Capacitively Coupled Driving for TFT-LCD" published in Proc. Japan Display '89, pages 580–583, and the paper by T. Kamiya et al entitled "A Novel Driving Method of TFT-LCD with Low Power Consumption" published in Proc. AMLCD '94, Tokyo, pages 60–62. In the former, the storage capacitor associated with a display element is connected to the preceding adjacent row address conductor and the step level follows the selection pulse signal while in the latter the storage capacitor is connected to the succeeding adjacent row address conductor, and the step level is before the selection pulse. The terms preceding and succeeding here refer to the sequence in which the rows are addressed.

These known schemes suffer from two problems. Firstly, the scan direction, that is, the order in which the rows of display elements are addressed, is predetermined by the way the storage capacitor is connected. Although the rows can be addressed in sequence, one at a time, from top to bottom for example, the scan direction cannot be reversed, whereby the rows are addressed from bottom to top, without changing the row conductor waveforms. It is sometimes advantageous to be able to reverse the scan direction, for example, in projection display systems where the projector unit can be either floor or ceiling mounted, or in car display systems where the display device can be mounted above or below the dashboard. Secondly, it is not possible to implement a dot-inversion drive scheme where the polarity of the display voltages on display elements in adjacent columns alternates, in addition to the polarity of successive display elements in a column alternating, i.e. a combination of column and row inversion. Such dot-inversion schemes are helpful in reducing the extent of perceived flicker, and in producing generally less horizontal cross-talk and better uniformity.

OBJECTS AND SUMMARY OF THE INVENTION

It is an object of the present invention to provide an active matrix display device which is operable in a capacitively coupled drive mode and in which the above limitations can be overcome.

According to the present invention, an active matrix display device of the kind described in the opening paragraph is characterised in that the drive circuit is arranged to provide in the row drive waveform applied to each row conductor a step level both before and after the selection pulse signal. By the relatively simple, and convenient, means of providing a further step level adjacent the selection pulse signal in symmetrical relationship to the existing step level, which may precede or follow the selection pulse signal, it is readily possible to reverse the scan direction for the display device. When scanned in reverse, the further step level operates in similar manner to the known step level for capacitively coupled driving purposes. Importantly, this further step level does not effect significantly the display element addressing when driving the display device in the original scan direction and conversely the known step level does not effect the display elements when the scan direction is reversed.

Moreover, and importantly, the provision of step levels to either side of the selection pulse signal enables a dot-inversion drive scheme to be used if desired. In a preferred embodiment enabling a dot-inversion drive scheme, the transistors of a row of display elements are alternately connected to first and second adjacent row conductors and the storage capacitors of the display elements in the row are connected respectively to the other one of first and second row conductors.

BRIEF DESCRIPTION OF THE DRAWINGS

Embodiments of the active matrix display devices in accordance with the invention will now be described with reference to, and as shown in, the accompanying drawings, in which.

It should be understood that the figures are merely schematic and have not been drawn to scale. It should also be understood that the same reference numbers are used throughout the figures to denote the same or similar parts.

DESCRIPTION OF THE PREFERRED EMBODIMENTS

Figure 1:
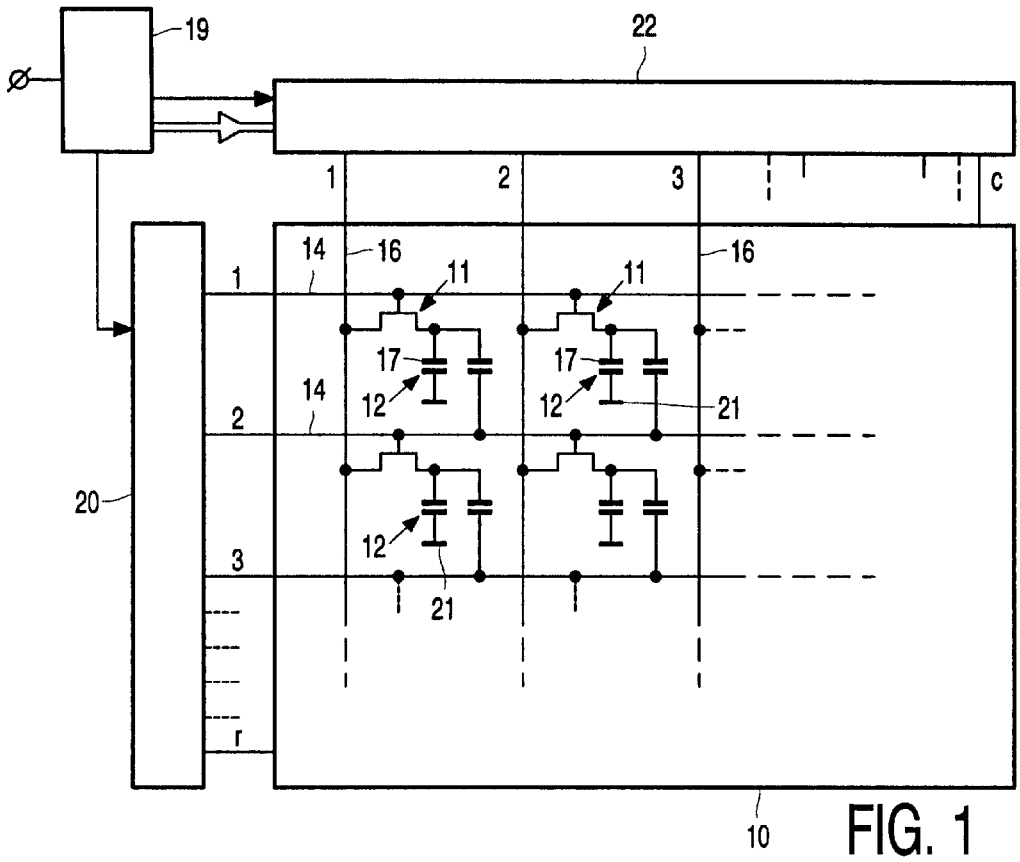
FIG. 1 is a simplified block diagram of one embodiment of the display device.

Referring to FIG. 1, the display device, which is suitable for displaying video pictures or graphics, comprises an active matrix addressed liquid crystal display panel 10 having a row and column array of display elements which consists of r rows (1 to r) with c horizontally arranged picture display elements 12 (1 to c) in each row. Only a few of the display elements are shown for simplicity.

Each display element 12 is associated with a respective switching device in the form of a thin film transistor, TFT, 11. The gate terminals of all TFTs 11 associated with display elements in the same row are connected to a common row conductor 14 to which, in operation, selection pulse (gating) signals are supplied. Likewise, the source terminals of the TFTs associated with all display elements in the same column are connected to a common column conductor 16 to which data (video) signals are applied. The drain terminals of the TFTs are each connected to a respective transparent display element electrode 17 forming part of, and defining, the display element. The sets of conductors 14 and 16, TFTs 11 and electrodes 17 are carried on one transparent plate while a second, spaced, transparent plate carries an electrode 21 common to all display elements. Liquid crystal is disposed between the plates and each display element comprises an electrode 17 and overlying portions of the liquid crystal layer and the common electrode 21. Each display element further includes a storage capacitor 18 which is connected between the display element electrode 17 and a row conductor 14 adjacent that to which the TFT 11 associated with the display element is connected.

In operation, light from a light source disposed on one side enters the panel and is modulated according to the transmission characteristics of the display elements 12. The device is driven on a row at a time basis by scanning the row conductors 14 sequentially with a selection pulse signal so as to turn on each row of TFTs in turn in a respective row address period and applying data (video) signals to the column conductors for each row of display elements in turn as appropriate and in synchronism with the gating signals so as to build up over one field a complete display picture. Using one row at time addressing, all TFTs 11 of the addressed row are switched on for a period determined by the duration of the selection pulse signal, which corresponds to less than an applied video signal line period, during which the data information signals are transferred from the column conductors 16 to the display elements 12. Upon termination of the selection signal, the TFTs 11 of the row are turned off for the remainder of the field time thereby isolating the display elements from the conductors 16 and ensuring the applied charge is stored on the display elements until the next time they are addressed, usually in the next field period.

The row conductors 14 are supplied successively with selection pulse signals by a row drive circuit 20 comprising a digital shift register controlled by regular timing pulses from a timing and control circuit 19. For a major part of the intervals between selection signals, the row conductors 14 are supplied with a substantially constant reference potential, e.g. zero volts, by the drive circuit 20 to hold the TFTs in their off state. Video information signals are supplied to the column conductors 16 from a column driver circuit 22 of conventional form comprising one or more shift register/sample and hold circuits. The circuit 22 is supplied with video signals and timing pulses from the circuit 19 in synchronism with row scanning to provide serial to parallel conversion appropriate to the row at a time addressing of the panel 10.

Figure 2A:
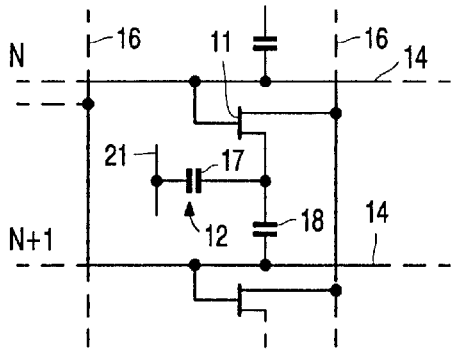
FIGS. 2A and 2B are equivalent circuit diagrams of two alternative arrangements of a typical display element and its associated TFT in the display device.
Figure 2B:
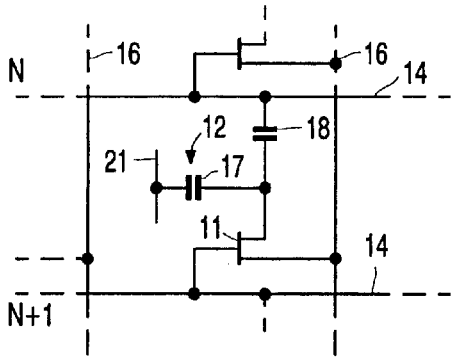

FIGS. 2A and 2B illustrate schematically the equivalent circuit for a typical display element in two alternative arrangements. In FIG. 2A, the gate of the TFT 11 is connected to a row conductor 14, in this example the Nth row conductor, and the storage capacitor 18 is connected at its one side to the node between the drain of the TFT 11 and the display element electrode 17 and at its other side to the next adjacent row conductor i.e. the $(N+1)^{th}$ row conductor 14. In FIG. 2B, the TFT's gate is connected to the $(N+1)^{th}$ row conductor while the storage capacitor 18 is connected between the display element electrode 17 and the previous, $N^{th}$, row conductor 14. The terms previous and next refer to the order in which the rows are addressed when vertically scanning normally, i.e. from row 1 to r in turn, so the previous row is addressed before the current row and the next row is addressed after the current row.

The display element circuit configurations of FIGS. 2A and 2B respectively are similar to those described in the papers by Kamiya et al and Takeda et al mentioned earlier. The display device is operable in a capacitively coupled drive mode similar to those described in the aforementioned papers to which reference is invited for further information about this particular technique and its advantages, and whose disclosure in this respect is incorporated herein by reference. Conventionally, the row drive waveform applied by the row driver circuit to each row conductor in a TFT type display device comprises a constant hold level ($V_h$) for maintaining the TFTs of the display elements associated with that row conductor in their off state for most of a field period and a selection pulse signal, (Vs), once per field period, of sufficient magnitude to turn on the TFTs whose duration corresponds to less than a line period of an applied video signal (e.g. 64 $\mu$s for a PAL standard video signal having a 20 ms field period) or less. In a capacitively coupled drive scheme, the row waveform is modified to include a step level which in the case of the FIG. 2A configuration immediately precedes the selection pulse signal and in the case of FIG. 2B configuration immediately follows the selection pulse signal. In both cases, the duration of the step level corresponds approximately to a line period or slightly greater. As the display device operates with field inversion, the step level in one field has a magnitude greater than the hold level, but less than the selection level, and in the next field has a voltage lower than the hold level. The basis of this scheme is that a display element, and likewise all other display elements in the same row, is charged via its associated TFT upon the application of a selection pulse signal to a voltage determined by the level of the data signal on the associated column conductor at that time, which lies between (Vsat−Vth)/2 and−(Vsat−Vth)/2, where Vsat and Vth are the saturation and threshold voltage levels of the LC display element. Once the TFT has been turned off, at the termination of the selection pulse signal, isolating the picture element, the voltage step level which then is present on one of the adjacent row conductors has the effect of coupling a voltage onto the display element capacitance via the storage capacitor so that the display element voltage is eventually taken to the required value in the range Vth to Vsat to provide the desired gradation. The coupling of the voltage onto the display element finally occurs at either the end of the step level on the preceding row conductor in the case of the FIG. 2B configuration or at the trailing edge of the selection pulse on the next row conductor in the case of the FIG. 2A configuration. By appropriate adjustment of the voltage of the step levels in both positive and negative fields it is possible to use this scheme to compensate for kickback effects.

In accordance with the present invention, the usual form of the row drive waveform supplied by the row drive circuit 20 is modified to include a further step level adjacent the selection pulse signal and arranged in time such that there is a step level both before and after the selection pulse. Thus, with regard to the waveforms for use with the configurations of FIGS. 2A and 2B respectively in which a step level is provided immediately preceding or immediately following the selection pulse, the further step level is provided immediately following or immediately preceding the selection pulse respectively. Both step levels in a field preferably have the same duration, corresponding approximately to a line period or slightly greater, and are of the same amplitude. In principle, the duration of the two step levels can be different, either greater than one video line period, possibly equivalent to two or even three line periods, or less than a line period provided that they terminate in time after the selection pulse signal on the adjacent row conductor. The step levels are preferably immediately adjacent the selection pulse signal but the step levels and the selection pulse could possibly be separated by a relatively short interval in which the row waveform voltage returns to the hold level or to another reference level. It must be ensured, however, that the step level on the relevant row conductor exists at the time the selection pulse signal on the adjacent row conductor controlling the TFT of the display element concerned terminates. For convenience, the duration selection pulse signals in the row waveforms is preferably slightly less than a video line period.

Figure 3:
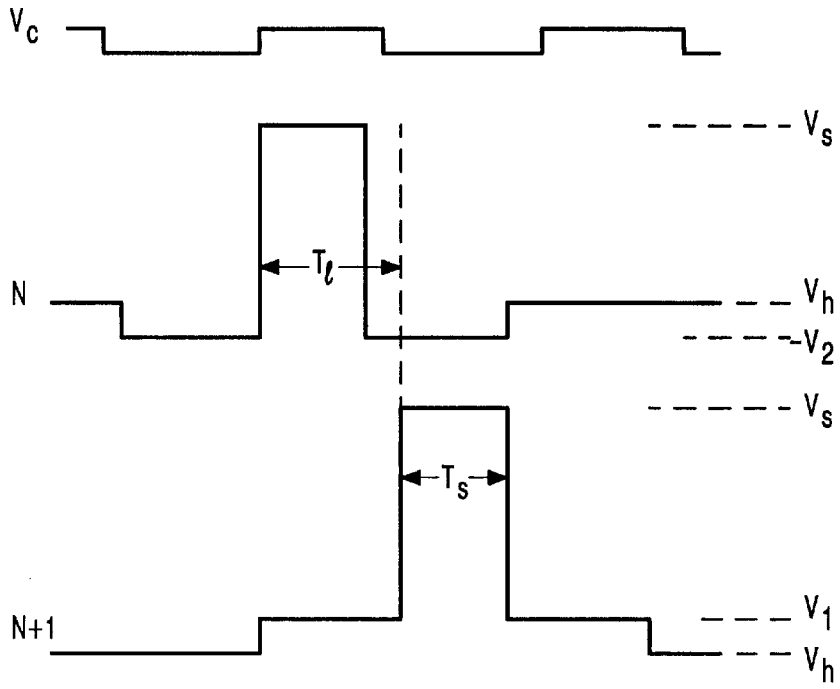
FIG. 3 illustrates parts of the waveforms applied to two successive row address conductors of the display device.

Because in effect the two step levels are arranged in time symmetrically with respect to the selection pulse, the same modified row waveform can be used for both the FIGS. 2A and 2B configurations. An example of the row waveforms for two successive row conductors 14, N and N+1, and their timing relationship is shown in FIG. 3, together with an example column conductor waveform, vc, containing data signals. $T_L$ and $T_s$ denote respectively a video line period and a selection pulse signal period. The row waveform for one row, row N+1, consists of a hold level, $V_h$, which may be zero volts, a selection pulse level $V_s$ of less than one video line time duration, and two step levels $V_l$ each similarly of one line time duration and at a level greater than $V_h$ but lower than $V_s$, i.e. below the gate voltage level. The display element array is driven in a line inversion mode such that in a given field the polarity of the voltages on the display elements of two adjacent rows is inverted, as well as in a field inversion mode, such that the polarity of the voltage on a display element in a given row in one field is inverted in the next field. Consequently, in the row waveform applied to a row conductor 14 adjacent the N+1 conductor, e.g. the N conductor, the two step levels are of opposite polarity to those for row N+1 and at a level $-V_2$. As can be seen from FIG. 3, the step level preceding the selection pulse $V_s$ for row N+1 coincides with the selection pulse on row N and the step level occurring after the selection pulse on row N coincides with the selection pulse on row N+1. In the next field, the waveforms applied to these row conductors will be reversed.

The principle of operation for the FIG. 2A type configuration with normal vertical scanning direction, i.e. from row l to row r, is as follows. Just before the trailing edge of the selection pulse Vs for one row the display element voltages reach a certain level approximately equal to the level of their respective data signal voltages. After the trailing edge, these display element voltages are offset due to the coupling of the trailing edge of the selection pulse via the gate-drain capacitance of the TFT. Because the value of the display element capacitance, and consequently the combination of the capacitances of the display element, the storage capacitor and the gate-drain capacitance, depends on the display element drive level this offset will vary from element to element. At this point in a field, then for a display element in row N the voltage on the row conductor N+1 to which the storage capacitor is connected is $V_1$. After both the selection pulse on row N+1 and the following voltage step $V_1$ have been completed the voltage on that row conductor returns to $V_h$. This produces an overall voltage step of amplitude $(V_1-V_h)$ at the row conductor end of the storage capacitor which in turn is coupled onto the display element via the storage capacitor to produce a final display element voltage for this field. This final voltage is, therefore, determined partly by the data signal level, partly by the offset caused by the gate-drain capacitance of the TFT which is dependent on the selection pulse level and this capacitance, and partly by the coupled voltage which itself is dependent in part on the step level voltage and the capacitance of the storage capacitor.

In the next field, the corresponding step level voltage differs. Thus, referring to FIG. 3, in the next field row N is driven with the waveform shown for row N+1 and vice versa. The final display element voltage is dependent in part on this different step level voltage. The two different values of the step level voltage determine both the mean and the peak to peak display element voltage and they can be chosen to fulfil a given set of criteria. The first is that the mean display element voltage should be equal to the mean column voltage. The mean display element voltage can be fixed at a constant value (in this case equal to the mean column voltage) independent of the drive level for the display element. In other words, the drive scheme automatically compensates for level dependent kickback effects.

The second criterion is based on the peak to peak display element voltage. This voltage, which determines the LC transmission, depends on the ratio of the capacitance of the storage capacitor to the combined capacitances of the display element, the storage capacitor and the gate-drain capacitance of the TFT. When the peak to peak column voltage is zero the rms display element voltage should be equal to $(V_{sat}+V_{th})/2$ so that the difference between the display element voltages in two successive fields is equal to $V_{sat}+V_{th}$. From this, suitable values for the voltages of the step levels used in alternate fields and alternate row waveforms can be deduced.

Figure 4:
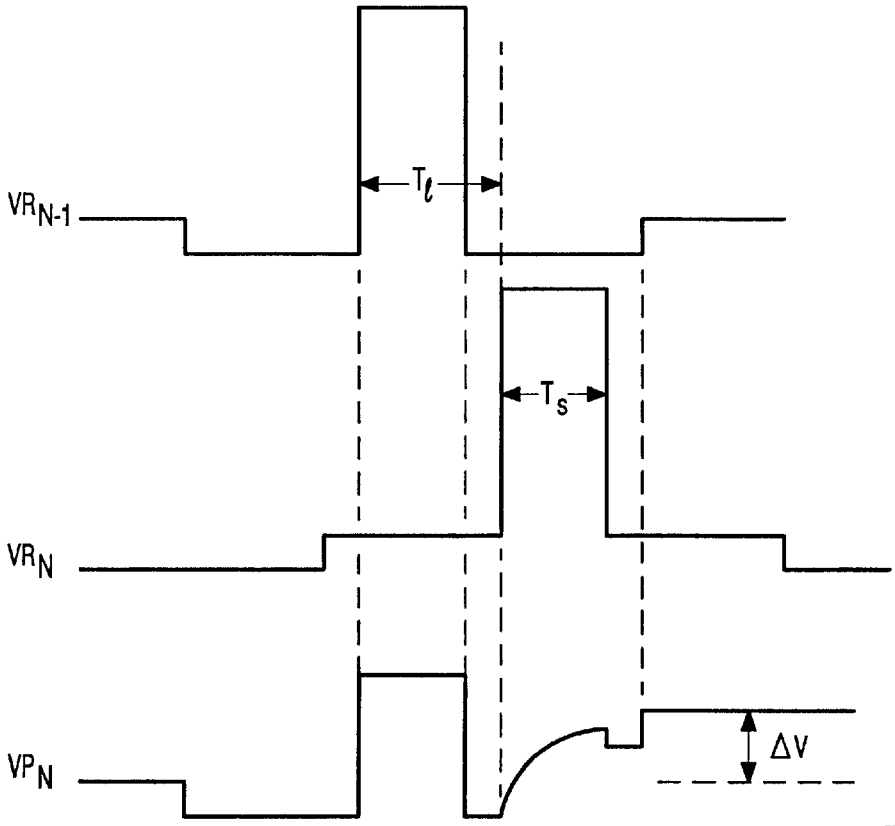
FIG. 4 illustrates example display element voltages produced for example in the case of the FIG. 2A arrangement.
Figure 5:
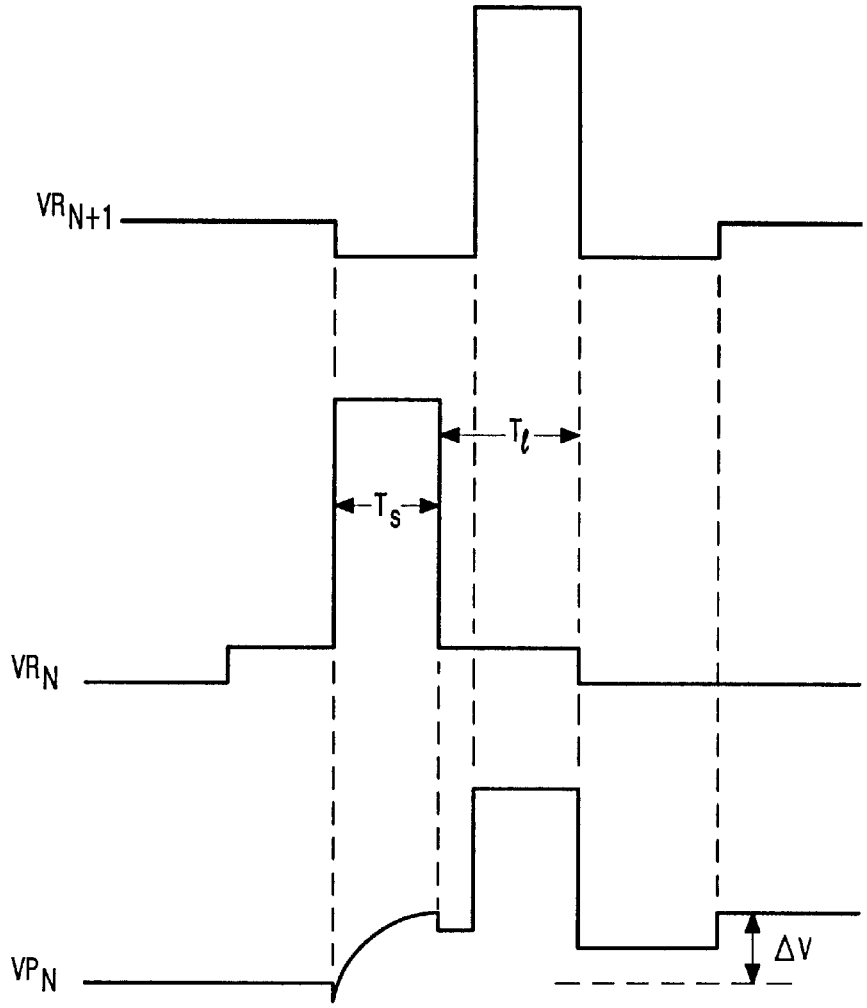
FIG. 5 illustrates example display element voltages produced for example in the case of the FIG. 2B arrangement.

By way of illustrating the operation of this capacitively coupled drive scheme, FIGS. 4 and 5 show examples of row conductor voltage waveforms and display element voltages, and more particularly display element voltage waveforms when the display devices is being driven as described above in both one vertical scanning direction and the opposite vertical scanning direction. These two scanning directions correspond to the case where the storage capacitor of a picture element is effectively connected to the previous and the next row conductor respectively. Here the terms previous and next again refer to the sequence in which the rows are addressed. FIG. 4 shows the voltage, $VR_{N-1}$, on row conductor N−1, and the voltage, $VP_N$, on a display element in row N in the case where the storage capacitor associated with the display element is connected to the previous row conductor, i.e. as in the FIG. 2B configuration when the array is being vertically scanned in the normal sense, from row l to row r in sequence, and as in the FIG. 2A configuration when the array is being scanned in the reverse direction, from row r to row l.

FIG. 5 shows the voltage, $VR_{N+1}$, on row conductor N+1, and the voltage, $VP_N$, on a display element in row N, in the case where the storage capacitor associated with the display element is connected to the next row conductor, i.e. as in the FIG. 2A configuration when the array is being vertically scanned in the normal direction and as in the FIG. 2B configuration when the array is vertically scanned in the opposite direction.

In each of the FIG. 4 and FIG. 5 cases, it is assumed that the same data signal level is applied to the display element and it can be seen that the display element voltage changes by the same amount, ΔV, independent of the direction of vertical scanning. The display element charging period, corresponding to the duration of the selection signal $V_s$ on the row conductor associated with the display element, is denoted by $T_s$.

It is therefore apparent that by introducing a further step level in the row drive waveforms in the manner described it is readily possible to reverse the vertical scanning direction as and when required and still obtain the correct required display element voltages whilst retaining the advantages of using a capacitively coupled drive scheme. Reversing the scan direction involves only the relative timings of the selection pulses in the row waveforms supplied by the circuit 20 and no change to the actual waveforms is necessary.

Figure 6:
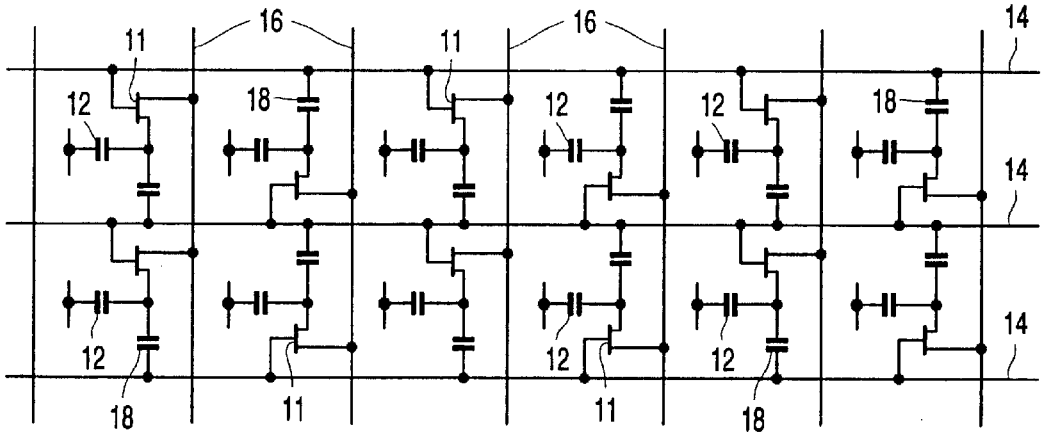
FIG. 6 shows an equivalent circuit diagram for several display elements in two adjacent rows in an alternative embodiment of the display device.

Moreover, it becomes possible as well to use a dot inversion drive scheme which is advantageous in overcoming certain problems affecting display quality. As with a row line inversion mode of operation the dot inversion mode results in the polarity of the display elements being reversed from row to row but in addition the polarity of the display elements is reversed from column to column. Thus, in one field, the polarities of several adjacent display elements in one row may be of +,−,+,− etc whereas the polarities of the corresponding display elements in the adjacent row would be −,+,−,+, etc. In the next field the individual polarities would be reversed. In order to achieve dot inversion, it is necessary for the drive signals on alternate column conductors to have opposite polarities, i.e. odd-numbered display elements in one row would be of one polarity while even-numbered display elements in the same row would be of opposite polarity. If a capacitively coupled drive scheme is used then the voltage coupled onto display elements in alternate columns from the steps in the row waveform must have opposite polarities. This is accomplished conveniently by connecting the storage capacitors of display elements in alternate columns to succeeding and preceding row conductors. Thus, the display elements lying in odd-numbered columns have their storage capacitors connected, for example, as in the FIG. 2A configuration to the preceding row conductor while the display elements lying in even-numbered columns have their storage capacitors connected as in the FIG. 2B configuration to the succeeding row conductor, (or vice versa). Such an arrangement is depicted schematically in FIG. 6 which shows several display elements in two adjacent rows. Half the display elements in the array are then driven with a capacitor connected to the previous row conductor and the other half are driven with a capacitor connected to the next row conductor. In this scheme a row of display elements is addressed over two row address periods because the transistors concerned are connected to two adjacent row conductors.

With such an arrangement it is necessary that the row waveform can deal with both types of storage capacitor configurations simultaneously. The waveform described above, in which there is a voltage step both before and after the selection pulse in the row drive waveform, allows this to be achieved.

From reading the present disclosure, various modifications will be apparent to persons skilled in the art. Such modifications may involve other features which are already known in the field of active matrix display devices and component parts thereof and which may be used instead of or in addition to features already described herein.

What is claimed is:

1. An active matrix liquid crystal display device comprising a row and column array of display elements each of which is connected to a transistor, sets of row and column address conductors connected to the transistors, each display element having an associated storage capacitor connected between the display element and a row conductor adjacent that to which the transistor associated with the display element is connected, and a drive circuit for applying data signals to the column conductors and, during a row address period for each row of display elements, a selection pulse signal to each row conductor in sequence for driving the display elements, the drive circuit being arranged to provide adjacent to a selection pulse signal in the row drive waveform a step level which exists at the termination of a selection pulse signal on an adjacent row conductor and which contributes to a drive voltage obtained on a display element via its associated storage capacitor, characterised in that drive circuit is arranged to provide in the row drive waveform applied to each row conductor a step level both before and after the selection pulse signal.

2. An active matrix liquid crystal display device according to claim 1, characterised in that for a row of display elements their associated transistors are alternately connected to a first adjacent row conductor and a second adjacent row conductor and their associated storage capacitors are connected respectively to the other one of said first and second row conductors.

3. An active matrix liquid crystal display device according to claim 2, characterised in that the drive circuit is arranged to drive the array of display elements with a dot-inversion drive scheme.

4. An active matrix liquid crystal device according to claim 3, characterized in that said step level has an intermediate value less than the selection pulse signal.

5. An active matrix liquid crystal device according to claim 3, characterized in that said step level is applied for a duration corresponding to at least approximately the duration of a line period.

6. An active matrix liquid crystal device according to claim 3, operated in a field inversion mode, the step levels have a first polarity, and during a next line period the step levels have a polarity opposite said first polarity.

7. An active matrix liquid crystal device according to claim 1, characterized in that said step level has an intermediate value less than the selection pulse signal.

8. An active matrix liquid crystal device according to claim 1, characterized in that said step level is applied for a duration corresponding to at least approximately the duration of a line period.

9. An active matrix liquid crystal device according to claim 1, operated in a line inversion mode, characterized in that during one line period the step levels have a first polarity, and during a next line period the step levels have a polarity opposite said first polarity.

10. An active matrix liquid crystal device according to claim 1, operated in a field inversion mode, wherein said selection pulse signal has a selection level, characterized in that said drive circuit applies a hold signal having a value lower than the selection level for a major part of the time between selection signals, and during one field period said step signal has a magnitude greater than the hold level and less than the selection level, and during the next field period said step signal has a magnitude lower than the hold level.

11. An active matrix liquid crystal device according to claim 7, characterized in that said step level is applied for a duration corresponding to at least approximately the duration of a line period.

12. An active matrix liquid crystal device according to claim 7, operated in a field inversion mode, the step levels have a first polarity, and during a next line period the step levels have a polarity opposite said first polarity.

13. An active matrix liquid crystal device according to claim 7, operated in a field inversion mode, wherein said selection pulse signal has a selection level, characterized in that said drive circuit applies a hold signal having a value lower than the selection level for a major part of the time between selection signals, and during one field period said step signal has a magnitude greater than the hold level and less than the selection level, and during the next field period said step signal has a magnitude lower than the hold level.

14. An active matrix liquid crystal device according to claim 2, characterized in that said step level has an intermediate value less than the selection pulse signal.

15. An active matrix liquid crystal device according to claim 2, characterized in that said step level is applied for a duration corresponding to at least approximately the duration of a line period.

16. An active matrix liquid crystal device according to claim 2, operated in a field inversion mode, the step levels have a first polarity, and during a next line period the step levels have a polarity opposite said first polarity.

17. An active matrix liquid crystal device according to claim 2, operated in a field inversion mode, wherein said selection pulse signal has a selection level, characterized in that said drive circuit applies a hold signal having a value lower than the selection level for a major part of the time between selection signals, and during one field period said step signal has a magnitude greater than the hold level and less than the selection level, and during the next field period said step signal has a magnitude lower than the hold level.

* * * * *